US009738366B2

(12) United States Patent
Gai et al.

(10) Patent No.: US 9,738,366 B2
(45) Date of Patent: Aug. 22, 2017

(54) CONTROL DEVICE FOR GENERATING AUXILIARY CONTROLS FOR A BOAT

(71) Applicants: Marcella Gai, Busalla (IT); Andrea Milanese, Busalla (IT); Enrico Pagani, Busalla (IT)

(72) Inventors: Marcella Gai, Busalla (IT); Andrea Milanese, Busalla (IT); Enrico Pagani, Busalla (IT)

(73) Assignee: Ultraflex S.p.A., Casella (IT)

( * ) Notice: Subject to any disclaimer, the term of this patent is extended or adjusted under 35 U.S.C. 154(b) by 0 days.

(21) Appl. No.: 14/867,324

(22) Filed: Sep. 28, 2015

(65) Prior Publication Data

US 2016/0090167 A1 Mar. 31, 2016

(30) Foreign Application Priority Data

Sep. 29, 2014 (IT) ..... GE2014A0096

(51) Int. Cl.

*B63H 21/22* (2006.01)
*B63H 21/21* (2006.01)
*B63H 25/02* (2006.01)

(52) U.S. Cl.

CPC ..... *B63H 21/213* (2013.01); *B63H 25/02* (2013.01); *B63H 2021/216* (2013.01); *B63H 2025/026* (2013.01)

(58) Field of Classification Search

CPC ..... B63B 39/061; B63B 1/22; B63B 1/286; B63H 21/213; B63H 2021/216; B63H 21/22; B63H 21/265; B63H 25/02; B63H 2025/022; B63H 2025/024; B63H 2025/026

See application file for complete search history.

(56) References Cited

U.S. PATENT DOCUMENTS 6,264,513 B1 * 7/2001 Marsh ..... B63H 21/213 114/286
7,172,478 B2 * 2/2007 Blair ..... B63H 21/213 440/87

* cited by examiner

*Primary Examiner* — Andrew Polay
(74) *Attorney, Agent, or Firm* — Themis Law

(57) ABSTRACT

Control device for generating auxiliary controls for a boat for controlling and regulating a boat handling auxiliary functionality, including an intermediate switch, changeover switch, or switch device located below the steering control member of the boat, which is connected to a drive unit for a steering actuator through a drive shaft; and a housing case shaped as an arm having at one end a member controlling the control device, which is provided with a terminal removably fastening alternatively to the casing holding the drive unit for the steering actuator, to a part thereof, or to a wall of a bridge or of a dashboard adjacently to the region for mounting the casing holding the drive unit for the steering actuator to the bridge or to the dashboard.

14 Claims, 11 Drawing Sheets

CONTROL DEVICE FOR GENERATING AUXILIARY CONTROLS FOR A BOAT

FIELD OF THE INVENTION

The present invention relates to a control device for generating auxiliary controls for a boat comprising at least one intermediate switch or changeover switch or switch device located below the steering control member of said boat such as a wheel, a steering wheel or the like.

The steering control member is connected to a drive unit for a steering actuator through a drive shaft.

Moreover the control device for the auxiliary functions comprises a member actuating an intermediate switch or changeover switch or switch device which is composed of an arm having at one end a member controlling said control device for generating auxiliary controls.

BACKGROUND OF THE INVENTION

Control devices for generating auxiliary controls are known and widely used not only in the marine field, but also in the motor field, for generating auxiliary controls that can help to handle the vehicle.

With a particular reference to the marine field, these control devices for example are in charge of the control of the motor trim, that is the inclination of the motors with reference to the transom or the orientation of the trim tabs, that is the tabs regulating the attitude of the boat hull.

The coming of electronic control systems installed on boats has led to the development of different possible functions that can be taken by such control devices, since by simply changing the configuration of the control system it is possible to use the intermediate switch or changeover switch or switch device for activating any actuating device connected to the electronic control system for performing any function.

Thus, the control devices for generating auxiliary controls can take any function, both of primary importance, such as for example acceleration/deceleration control, and of lower importance such as for example turning on an apparatus on the boat.

The main advantage offered by such control devices for auxiliary functions is the fact that the actuating member can be placed near the steering control member, that is the wheel or steering wheel, such as for example exactly below said wheel or steering wheel such to allow the user to actuate auxiliary controls, in a simple manner and without the need of removing the hands from the steering wheel and therefore without losing the steering control of the boat and at the same time a stability in the position of the person in charge of handling the boat.

Generally the steering wheel or wheel act not only as steering control members but also as grip handles for the user steering the boat.

Under the same high adaptability to the several functions, the known prior art devices have a poor adaptability to the different types of boats and above all to the different types of installations.

The drive unit for the steering actuators can be of the hydraulic, electric, electromechanical, electronic, electrohydraulic or even only mechanical type. Depending on the several types of the plant, the steering shaft controlled by the steering control member, that is the wheel or steering wheel has several functions, however in all the variants such shaft is the input shaft of a mechanism transforming/transmitting the rotational mechanical motion into a steering actuating movement or in electric/electronic or hydraulic signals corresponding to the rotational mechanical motion, which mechanism is enclosed in a case intended to be mounted on or in the instrument panel of the bridge or of the dashboard.

For example, in the oil-hydraulic (hydraulic) version, the drive unit can be composed of a pump or of a control unit for the trim tabs that are controlled both by the wheel or steering wheel.

Since ergonomics and easiness in the control are important aspects of such devices, considering above all the fact that the steering wheel or the like, often and in contrast with a good handling rule, is also a stabilization element for the steersman, the devices known in the prior art are installed during the phase manufacturing the boat and are made on the basis of the constructional characteristics thereof The constructional characteristics of the steering control member, such as for example the distance of the wheel from the bridge or from the drive unit, change depending on the boat, therefore the control devices for generating auxiliary controls have to be installed such to allow the user to easily operate them.

It derives that the control devices known in the prior art have to be made in a manner different time by time depending on the boat and possibly on the auxiliary function controlled thereby.

Moreover, in case of upgrades of boat handling plants related to the addition of handling functionalities besides those already present, such as for example the addition of elements for adjusting the attitude (so called trim tabs) or servo-controlled functionalities for the inclination of the motor with respect to the transom it is necessary to integrate the control bridge with the members for controlling the units intended to provide such auxiliary functions. These control members therefore require configurations suitable for being added in the most ergonomically favorable position for being used by the user in a manner harmonized with the other control members provided on the control bridge such as particularly the steering control members.

Therefore, there is the need not satisfied by the devices known in the prior art to provide a control device for generating auxiliary controls for a boat that solves the drawbacks of the devices known in the prior art.

A particularly important aspect is to provide a control device for generating auxiliary controls that allow a user to use the device without substantially removing or by removing only for a short time the hand or hands from the control member of the boat.

SUMMARY OF THE INVENTION

The present invention achieves the above objects, wherein the control device for generating auxiliary controls is provided with a terminal removably fastening alternatively to the casing holding the drive unit for the steering actuator or to a part thereof or to a wall of the bridge or of the dashboard in a region adjacent to said casing holding the drive unit for the steering actuator.

In one embodiment the removable fastener means for the control device for generating auxiliary controls are composed of a clamping annular element, intended to surround the casing holding the drive unit and to be clamped against the shell surface of said holding casing, while said annular element or an appendage associated thereto are the compartment housing the intermediate switch or changeover switch or switch device and the mechanism for driving it controlled by the control member of said control device.

The control member of the control device for generating auxiliary controls for the boat advantageously is composed of an oscillating lever (2) or one or more push-buttons or of a lever of the joystick type.

Particularly, the device of the present invention provides the possibility of adapting the annular element depending on the characteristics and on the dimensions of the drive unit.

In one embodiment, said annular element is made as flexible and adaptable to the shape of the shell of said casing holding said drive unit for the steering actuator or actuators for at least a part of the length thereof.

A variant can provide said annular element to be made like a flexible annular band clampable around said holding casing and that passes through loops of a case housing the mechanism driving the intermediate switch or changeover switch or switch device.

A further variant on the contrary provides the annular element to be in the form of a rigid frame that is fastenable to the casing by a form-fit or that is made of two parts removably connectable with each other and that can be clamped against the surface of the holding casing for example by means of screw connection means for the two parts.

Since generally the casings have an at least partially cylindrical shape, also the annular element is circular and with such a size that it can be clamped against the cylindrical wall of the holding casing.

Still another variant on the contrary provides the casing holding the drive unit for the steering actuators to be already provided with fastening seats for the control device for generating auxiliary controls, which in turn has fastener elements made in a manner corresponding to the fastening seats for example threaded holes and through holes respectively for fastening screws.

One embodiment provides the annular element to be divided into two complementary semi-annular elements, a first semi-annular element and a second semi-annular element, according to a transverse, preferably diametric, plane.

The semi-annular elements further are designed to be coupled/uncoupled by removable fastener means, in a clamping condition and an open condition respectively of the annular element relative to the drive unit.

Besides the possibility of adapting the device of the present invention to any boat regardless of the constructional characteristics, it is clear how the possibility of providing two semi-annular elements allows the device of the present invention to be installed also once all the boat components have been assembled.

Moreover, as it will be clear from some embodiments shown and described below, such arrangement allows the device of the present invention to be height-adjusted particularly relative to the steering wheel, by adapting it on the basis of the constructional characteristics of the steering wheel.

The positioning of the control device is important, since the distance of the control members has to be always such to allow said members to be operated without removing the hand from the steering wheel.

The removable fastener means can be of any type known in the prior art, preferably they can be made such to allow the two semi-annular elements to be easily and safely coupled/uncoupled.

Advantageously the removable fastener means are composed of at least one screw engaging into a corresponding engagement seat, at least partially threaded, provided in the thickness of the annular element, secant to the radially outermost annular edge.

The radially outermost annular edge has an opening intended for the insertion of the screw into the corresponding engagement seat.

Accordingly, the engagement seat is composed of two parts, a first part is provided in the thickness of the first semi-annular element and a second part is provided in the second semi-annular element.

Preferably the removable fastener means comprise two screws engaging into two corresponding engagement seats, the engagement seats being provided one opposite to the other one in the thickness of the annular element, secant to the radially outermost annular edge near the interface ends of the two semi-annular elements.

The provision of two screws improves the possibility both of regulating the opening of the two semi-annular elements, and of regulating the force with which the two semi-annular elements clamp the drive unit.

As an alternative to the above, it is possible to provide the removable fasteners means to be composed of a screw engaging into a corresponding engagement seat provided in the thickness of the annular element, secant to the radially outermost annular edge near two ends of the semi-annular elements, while near the other two ends there is provided an engagement hinge that allows said two semi-annular elements to be coupled by rotating them about an axis passing by the hinge.

The case of the switch device can be provided as one piece with at least one of the semi-annular elements, preferably made of a plastic material, such to obtain the piece ready to be installed by means of a single mold.

As an alternative, it is possible to provide the case to be fastened to the annular element in any manner known in the prior art, such as for example a form-fit, gluing, welding etc.

According to a preferred embodiment, the head side and/or the side opposite to the head side have at least one fastening hole for fastening the arm.

According to a possible embodiment, the radially innermost annular edge has at least one housing seat for housing a friction element intended to limit or eliminate the relative displacement between the annular element and the drive unit.

Such arrangement allows the user to have the switch device always in the same position, regardless of the force applied on the lever.

The present invention further relates to a control device for generating auxiliary controls for a boat comprising at least one intermediate switch or changeover switch or switch device preferably electric one, that is drivable by a drive mechanism provided with a manual drive member and that is located below the steering control member of the boat in such a position that said drive member for the switch drive mechanism is drivable by one hand without substantially removing the hand from the steering control member, for example a steering wheel.

The control device for generating auxiliary controls, comprises an arm supporting a case housing the switch, the switch drive mechanism and the drive member for said switch drive mechanism, which case is provided at one end of said support arm and which support arm has a fastening foot like a case at the opposite end.

Said fastening foot can be a support plate having fastening holes for fastening the plate to the boat.

The support plate can be fastened in any position, particularly it can be fastened to a wall of a bridge or of a dashboard near the casing of the drive unit for the steering actuator and just below the steering control member or directly to the casing holding said drive unit.

According to one embodiment the switch device comprises an electromechanical unit closing or opening the contacts or for the changeover of the contacts or for reversing the contacts or also an electronic control unit for generating control signals, which unit is housed in the arm and it is activated by the movement of the lever, such that the switch device passes from an inactive condition to an active condition as regards the closure or opening of the contacts or the generation of control signals on the basis of the movement of the lever.

In a preferred embodiment, the lever is supported so as to oscillate and the oscillation motion thereof is transmitted to the mechanical member controlling an electric intermediate switch or changeover switch or switch device of the conventional type such as a micro switch or the like.

As an alternative to the switch devices of the conventional type, that is that can be acquired on the market complete with contacts and mechanical control members it is possible to provide contacts on movable parts and fixed parts of the activation mechanism controlled by the lever that are brought in the mutual contact position or separation position by the movement of the lever.

Still according to a preferred embodiment, the switch device has at least two switching positions, while there are provided elastic means that firmly force the switch device in a switching condition, while the second switching position is unstable.

In this case, the switch device has a function similar to that of a push-button changeover switch wherein a switching position is stable and the second one can be obtained by an action forcing the control members and which is maintained only till the forcing action is maintained on the control member.

In particular, such elastic means act on the switch drive mechanism or on the control lever thereof by bringing said mechanism or the lever firmly in the position corresponding to one of the switching positions and requiring a constant force for keeping the lever or the drive mechanism in the condition corresponding to the second switching position.

In the case of the above described embodiment, the control lever allows control pulses to be generated that then are read and interpreted by the electronics and converted into corresponding actuation controls of the functionalities added to the steering control one.

By such embodiment it is possible to step-like regulate the actuation of an auxiliary handling device, such as the trim of the motors or the position of the trim tabs or also the number of revolutions of the motor and/or the switching condition of the reversing gear or the idle condition.

Moreover, it is possible to provide a functionality wherein an electronic unit interpreting the control pulses generated by the switch device detects the duration of the pulse corresponding to the duration for which the unstable switching condition is maintained by a voluntary action driving, continuously over time, the control lever or the like it converts the control, usually a pulse control, into a continuous variation of the controlled actuation action that lasts till the activation action on the lever is maintained. Thus for example if a single pulse causes a change of the trim, of the trim tab or of the number of revolutions of the motor by a given predetermined variation step, the continuous operation of the control lever for generating a pulse with a given duration causes the variation to be applied in a continuous manner by predetermined steps or according to a predetermined increase or decrease ramp, while said variation of the trim, of the position of the boat trim tabs or of the number of revolutions of the motor will stop only at the end of the operation of the control level, that is upon its release.

As it will be clear from some embodiment shown below, the lever has such a shape to facilitate its movement without removing the hands from the steering wheel, such to generate the control signals in a simple manner.

Preferably, the lever is mounted on the arm in a manner rotatable about an axis provided in a vertical plane radial relative to the axis of rotation of the steering control member or of the shaft controlled thereby or parallel to said radial direction, such that a rotation of the lever, in the clockwise direction or counterclockwise direction, leads to two different switching conditions of the contacts of the switch device respectively.

This characteristic further facilitates the control of the lever, since it is sufficient to operate the lever by pulling or pushing one end thereof for modifying the switching conditions of the contacts of the switch device, for example closing the contacts, and for allowing the control signal to be generated.

According to a further embodiment, there are provided elastic means maintaining the lever in position, such to firmly maintain the lever in a switching condition corresponding to an inactive condition of the controlled actuators of the auxiliary function, for example corresponding to the open condition of the switch device.

Such characteristic allows advantages to be achieved as regards safety, since each time the lever is released and it is not more subjected to any force, it goes back in the initial condition such to open the switch and to stop the generation of control signals.

Such characteristic is particularly advantageous in the case of the use of the device of the present invention as a control for the motor trim.

In order to regulate the sensation the user feels when using the lever, means regulating the elasticity of the means maintaining it in position are preferably provided.

One embodiment provides the lever to be in the form of a rocker lever and to be integrally fastened so as to rotate about an axis provided in a vertical plane radial to the axis of rotation of the steering control member or of the shaft controlled thereby or parallel to said radial direction, which axis is transverse to the longitudinal axis of said lever and passes by an intermediate region thereof with reference to the length extension of said lever.

In this case, the switch device can have three switching conditions, a neutral one where no forces act on the lever and it is maintained in a stable position, preferably but not necessarily in a plane horizontal or parallel to the plane subtended by the steering control member for example the steering wheel or the like and two active positions closing a first and a second contact respectively for generating a first pulse and a second pulse which first and second pulses can be interpreted as controls increasing or decreasing an actuation condition of an auxiliary function, such as the motor trim, the position of the trim tabs or the number of revolutions of the motor.

As set forth above, since the invention aims at providing a control device for generating auxiliary controls for a boat in a easy manner and without the need of removing the hands from the control member, the invention also relates to a device comprising at least one push-button element located below the boat steering control member.

The push-button element provides the push-buttons facing a direction opposite to the control member and it is supported by a support arm.

The positioning of the push-buttons in a direction opposite to the control member allows an operator to push the push-buttons with the fingers without removing the hands from the control member, as it will be more clear from the description of some embodiments.

According to a possible embodiment, the control member is connected to a bridge, the support arm being connected by one end thereof to the bridge.

According to a further embodiment, the control member is connected to a drive unit, the support arm being connected by one end thereof to said drive unit.

Regardless of the connection of the support arm, both whether it is connected to the drive unit or to the bridge, it is possible to provide the end of the support arm to be connected by an hinge, such to allow the support arm to rotate which is hinged at the connected end, in order to obtain an height-adjustment of the push-button element.

Finally, the present invention relates to a control device for generating auxiliary controls for a boat, which boat comprises at least one control member located above a bridge.

The control device of the present invention is composed of a device of the joystick type connected to said bridge.

BRIEF DESCRIPTION OF THE DRAWINGS

These and other characteristics of the present invention will be more clear from the following description of some embodiments shown in the annexed drawings wherein.

It should be noted that the figures show some embodiments of the device of the present invention for understanding better the advantages and the characteristics thereof.

Such embodiments, therefore, have to be considered as explanatory and not as a limitation of the inventive concept of the present invention, that is to provide a control device for generating auxiliary controls for a boat that is easily adaptable to any type of boat.

DETAILED DESCRIPTION OF EMBODIMENTS OF THE INVENTION

The control device for generating auxiliary controls for a boat according to the present invention comprises at least one control or actuation member for an intermediate switch or changeover switch or switch device located below the steering control member of the boat.

The term intermediate switch or changeover switch or switch device means any unit able to generate control pulses of the mechanical, electric, hydraulic, electronic or pneumatic type obtained by driving a manual control member and which pulses are interpreted by actuators for performing auxiliary functions for a boat, such as particularly but not as a limitation, the inclination of one or more motors or drives of the motors so-called trim, the position with respect to the transom of the boat of said motor or motors or drive or drives of said motors, the position of one or more trim tabs of the boat, the regulation of the number of revolutions of the motor, the setting of the reversing gear of the motor, that is of the ahead movement, astern movement and neutral gear and other further possible functions such as for example also the so called tilt of outboard motors.

The steering control member generally is in the form of a wheel or a steering wheel and it is connected to a drive unit for the steering actuators through a drive shaft.

In one embodiment, the switch device comprises an arm-like case 1 having at one end an actuation lever 2.

In the variant embodiment of FIGS. 1 to 5, the drive unit is composed of an axial piston pump that is known in the prior art for the steering control of boats of the oil-hydraulic type, where the pump feeds oil to a hydraulic cylinder controlling the steering arm of a motor, for example an outboard motor or a blade of a rudder or a drive of a stern drive or the like.

Pumps of this type are housed within a substantially cylindrical casing 3 that bears a pump drive shaft on which a wheel driving said shaft is directly mounted.

The steering control member of the boat, that can be composed of a wheel or the like that moves the drive shaft 10, as in the steering systems known in the prior art is not shown in the figures.

Figure 1:
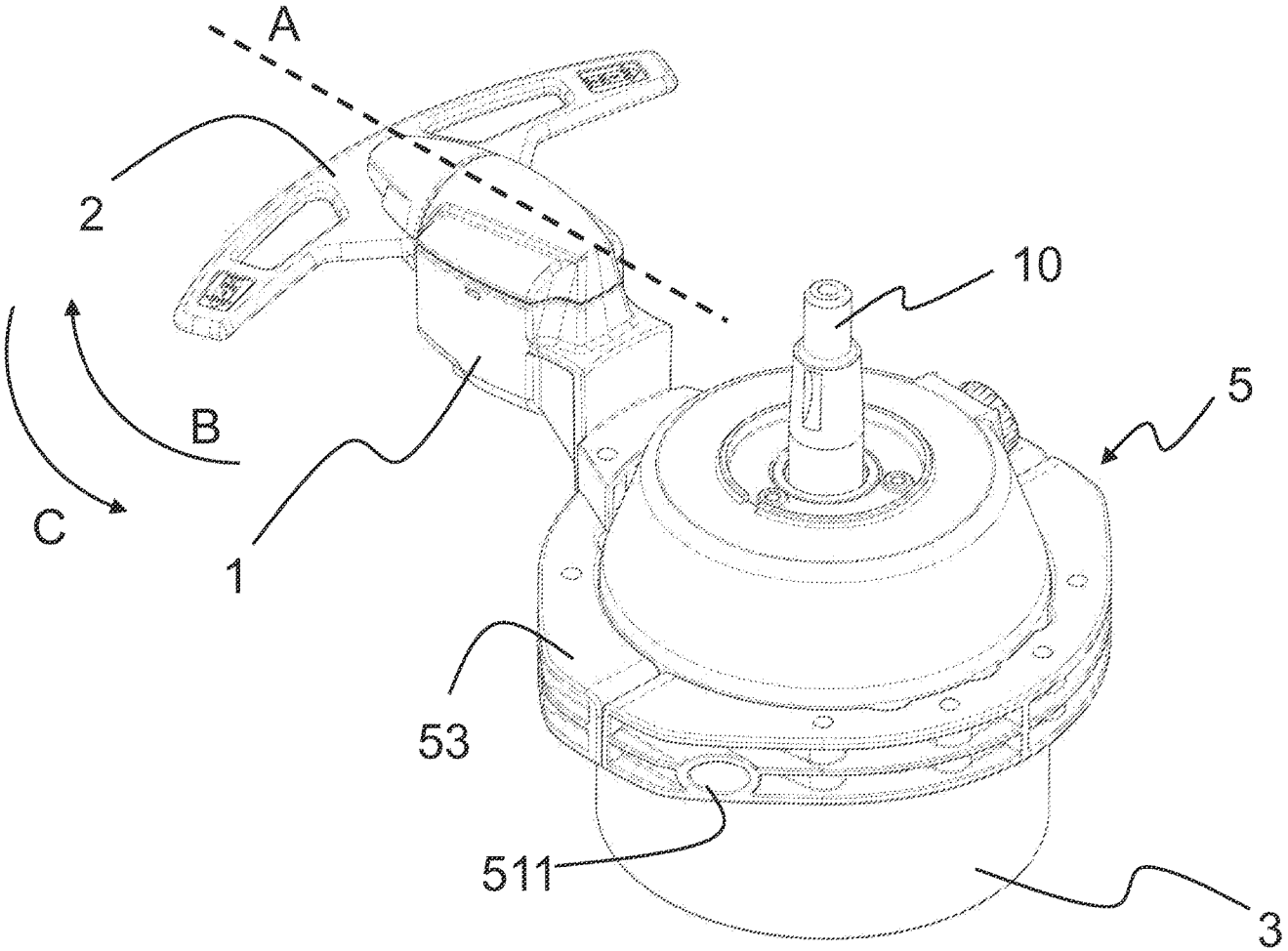
FIG. 1 is the device of the present invention according to a possible embodiment.
Figure 2:
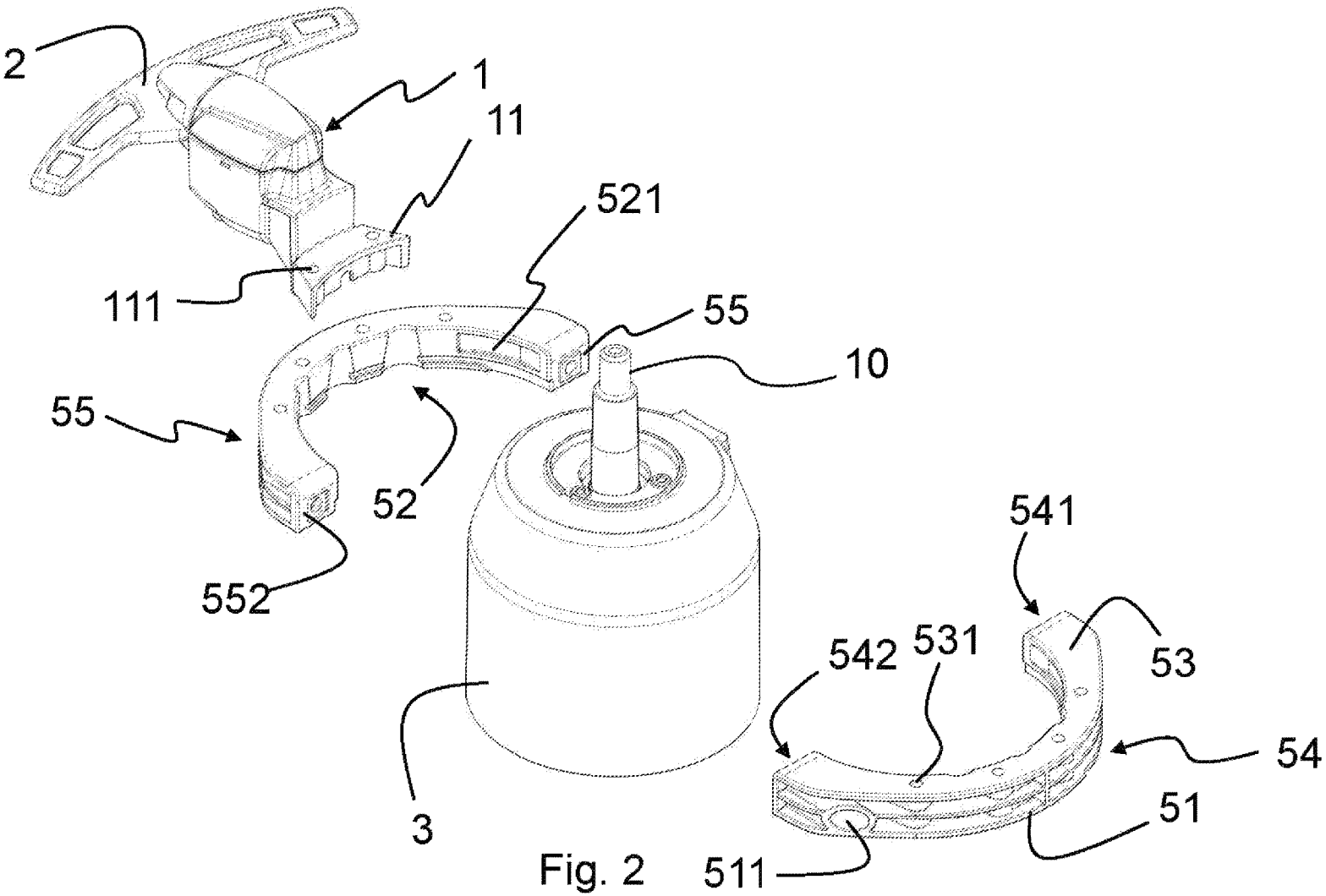
FIG. 2 is an exploded view of the device of FIG. 1.
Figure 3:
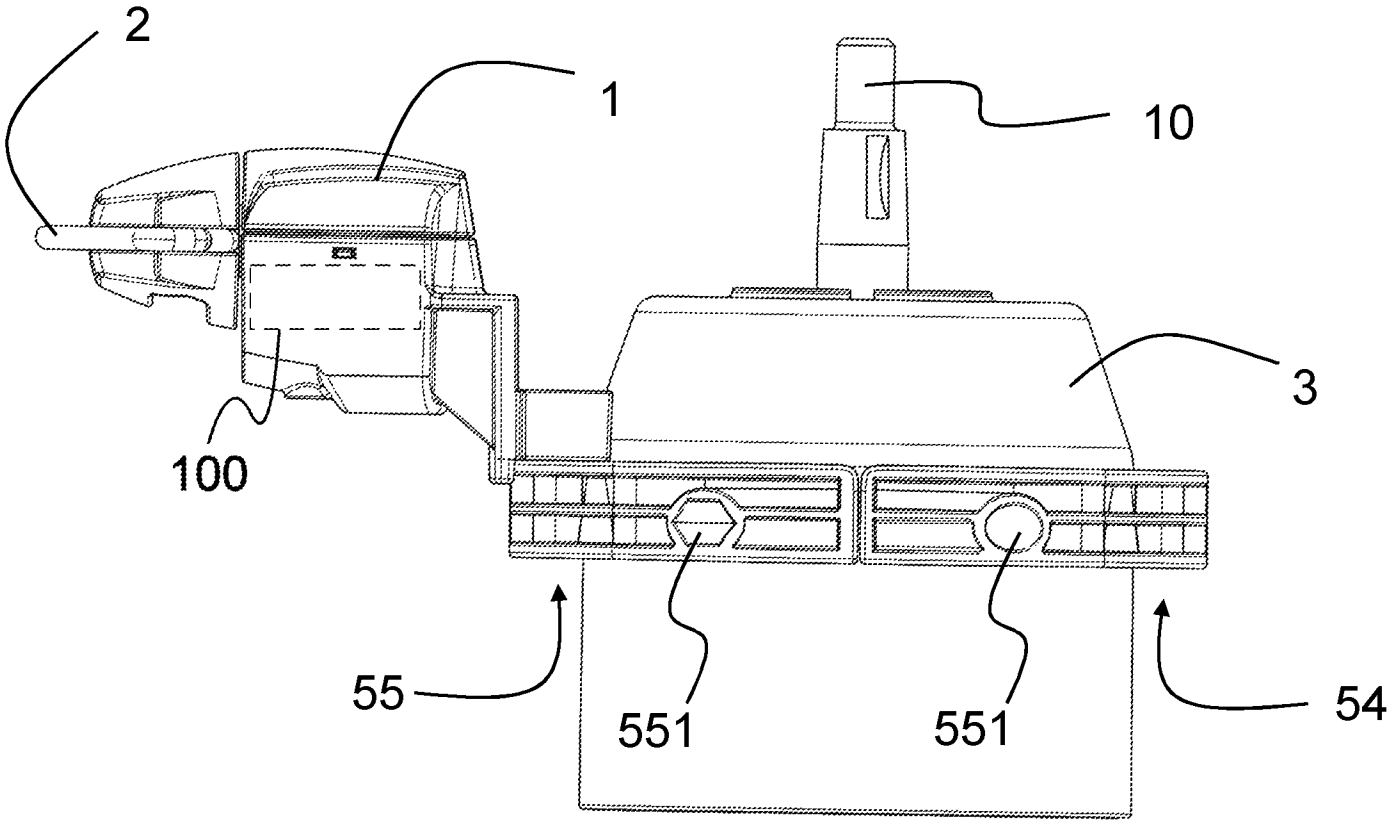
FIGS. 3 and 4 are a side view and a top view respectively of the device of the present invention according to the embodiment of FIG. 1.
Figure 4:
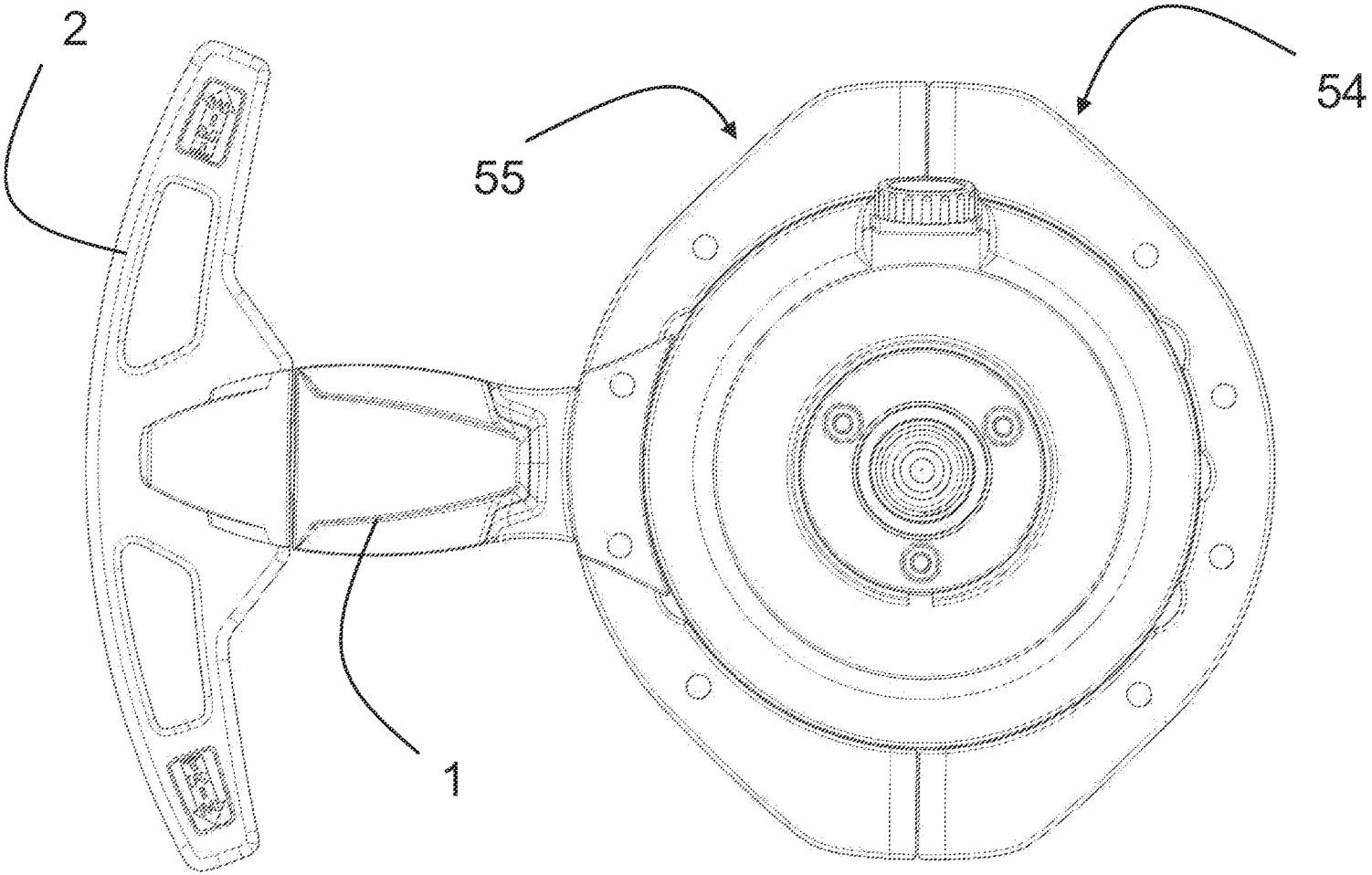

With a particular reference to FIGS. 1 and 2, the arm 1 is supported by a support element composed of an annular element 5 like a clamping frame or ring comprising a radially innermost annular edge 52 intended to surround the drive unit and a radially outermost annular edge 51.

The radially innermost annular edge 52 is connected to the radially outermost annular one 51 through a head side 53 facing the steering control member (not shown but intended to be fitted on the end of the drive shaft 10) and through a side opposite to the head side 53.

According to the variant shown in the FIGS. 1 to 6, the annular element 5 is divided into two complementary semi-annular elements, of which a first semi-annular element 54 and a second semi-annular element 55, according to a transverse, preferably diametric, plane, with respect to the casing 3 holding the pump that composes the drive unit for the steering actuator that in this example is composed of an actuator cylinder (not shown).

The semi-annular elements 54 and 55 are designed to be coupled/uncoupled by removable fastener means in a clamping condition and an open condition respectively of the annular element 5 relative to the drive unit.

Particularly in FIG. 1, the semi-annular elements 54 and 55 are shown in the condition coupled around the outer casing 3 of the pump, while in FIG. 2 they are shown in the uncoupled condition.

It is specified that in FIG. 1 the two semi-annular elements 54 and 55 in the coupled condition form a continuous annular element 5, but depending on the dimensions of the drive unit such semi-annular elements 54 and 55 can be coupled but not in contact with each other by the facing head ends of the semi-annular shape.

From the description of the characteristics of the removable fastener means disclosed below it will be clear how both the configurations are possible.

Moreover in FIG. 2 there are provided two interface surfaces 541, 542, 551, 552 at the ends of each of the two semi-annular elements 54 and 55.

Depending on the variant embodiment disclosed, the interface surfaces 541, 542, 551, 552 are in contact in the coupling condition of the two semi-annular elements 54 and 55.

Moreover, the interface surfaces 541, 542, 551 and 552 can have coupling members that have complementary surfaces two by two.

For example, it is possible to provide the interface surface 541 to have a protrusion towards the semi-annular element 55, while the complementary interface surface 551 to have a recess with a shape complementary to the protrusion of the interface surface 541.

Advantageously, the annular element 5 surrounds the drive unit holding casing 3 that has a cylindrical shape, that is it has a circular section.

However, the holding casing 3 may have any other sectional shape and/or any other shape, the annular element 5 having a radially innermost annular edge 52 with a shape corresponding to the shape of the section of said casing 3 or said annular element being made flexible and adaptable to the shape of the section of the casing 3.

In the case of a flexible annular element, it can be composed of a flexible band of any suitable material for example in the form of a strap of plastic or metal material that at its ends has means coupling said ends in the clamping condition against the casing 3.

In this case, it is possible for the annular element to be a single piece like an open ring the two facing ends of said open ring having means for the mutual connection and pulling one towards the other one like a buckle or for example like tightening clamps that have a notched surface intended to cooperate with an elastic retaining tooth provided in the clamping buckle on one end of the band.

According to the embodiment shown in FIGS. 1 to 6, the removable fastener means are composed of at least one screw, not shown in the figures, engaging into a corresponding at least partially threaded engagement seat, formed in the thickness of the annular element 5 secant to the radially outermost annular edge 51.

In particular the radially outermost annular edge 51 has an opening 511 for the insertion of the screw into the corresponding engagement seat.

Since the annular element 5 is composed of two semi-annular elements 54 and 55, the engagement seat is composed of two parts, a first part provided within the thickness of the first semi-annular element 54 and a second part provided within the thickness of the second semi-annular element 55.

In the coupled condition of the two semi-annular elements 54 and 55, the two parts form a single engagement seat for the screw.

Advantageously, the removable fastener means are composed of two screws engaging into two corresponding engagement seats, made as described above.

Particularly, the engagement seats are provided one opposite to the other one in the thickness of the annular element 5, secant to the radially outermost annular edge 51 near the interface ends 541, 542, 551, 552 of the two semi-annular elements 54, 55.

In the embodiment shown in the FIGS. 1 to 6, the housing seat for the screw is made as passing through the two semi-annular elements 54 and 55, therefore each element 54, 55 has two openings 511 for the insertion of the screw.

As an alternative the engagement seat for the screw can be made as blind, that is each semi-annular element 54, 55 can have only one opening 511.

Regardless of the configuration of the engagement seat, the first part composing the engagement seat can have an abutment element for the screw head, while at least the other part composing the engagement seat is threaded.

According to such configuration, in the engagement position the tightening of the screw allows the two semi-annular elements 54 and 55 to be coupled, since the provision of the abutment element allows the screw to push one semi-annular element against the other one.

As an alternative to the above, the removable fastener means can be composed of a screw engaging into a corresponding engagement seat provided within the thickness of the annular element 5, such as described above, that is secant to the radially outermost annular edge 51 near two ends of the semi-annular elements 54 and 55, while at the other two ends there is provided an engagement hinge that allows the two semi-annular elements 54, 55 to be coupled by rotating them about an axis passing by the hinge.

According to a preferred variant embodiment, the head side 53 and/or the side opposite to the head side 53 have at least one fastening hole 531 for fastening the arm 1.

The arm 1 that composes the case housing the intermediate switch or changeover switch or switch device 100 and the drive mechanism for said device can be made at least for a part thereof as a single piece with the annular element 5 or with one of the two parts 54, 55 of said annular element 5.

In the variant shown in the figures, said at least one part of the housing case that is of the arm 1 on the contrary is made as a piece separated from said annular element 5 or from one of the parts 54, 55 forming it.

In this case, among the several possibilities for mutually fastening the housing case or the arm 1, that is the at least one part thereof to the annular element 5 or to a part 54, 55 thereof the shown variant have several holes 531 arranged along the surface of the head side 53 such to adjust the fastening of the arm 1 along such surface, that is in order to fasten the arm 1 in several angular positions with respect to the casing 3 holding the drive device for the steering actuators.

The arm 1 has one end 11 with corresponding holes 111 coupling with holes 531, such to be fastened in any manner known in the prior art.

It is possible to make the arm 1 and the semi-annular element 55 as a single piece, as it is also possible to provide the arm 1 to be welded or glued to the semi-annular element 55.

It is also possible to provide a connection between the arm 1 and the annular element 5 of the snap fit and/or form fit type.

Moreover, in the figures only one arm 1 is always shown, but it is possible to provide to connect at least two arms, one for each semi-annular element 54 or 55, or several arms, on the basis of constructional needs, such to obtain the desired number of switch devices.

The holes 531 or the means coupling the arm 1 to the annular element 5 of any other type can be provided on the head side 53 or on the opposite side or on both of them.

Figure 6:
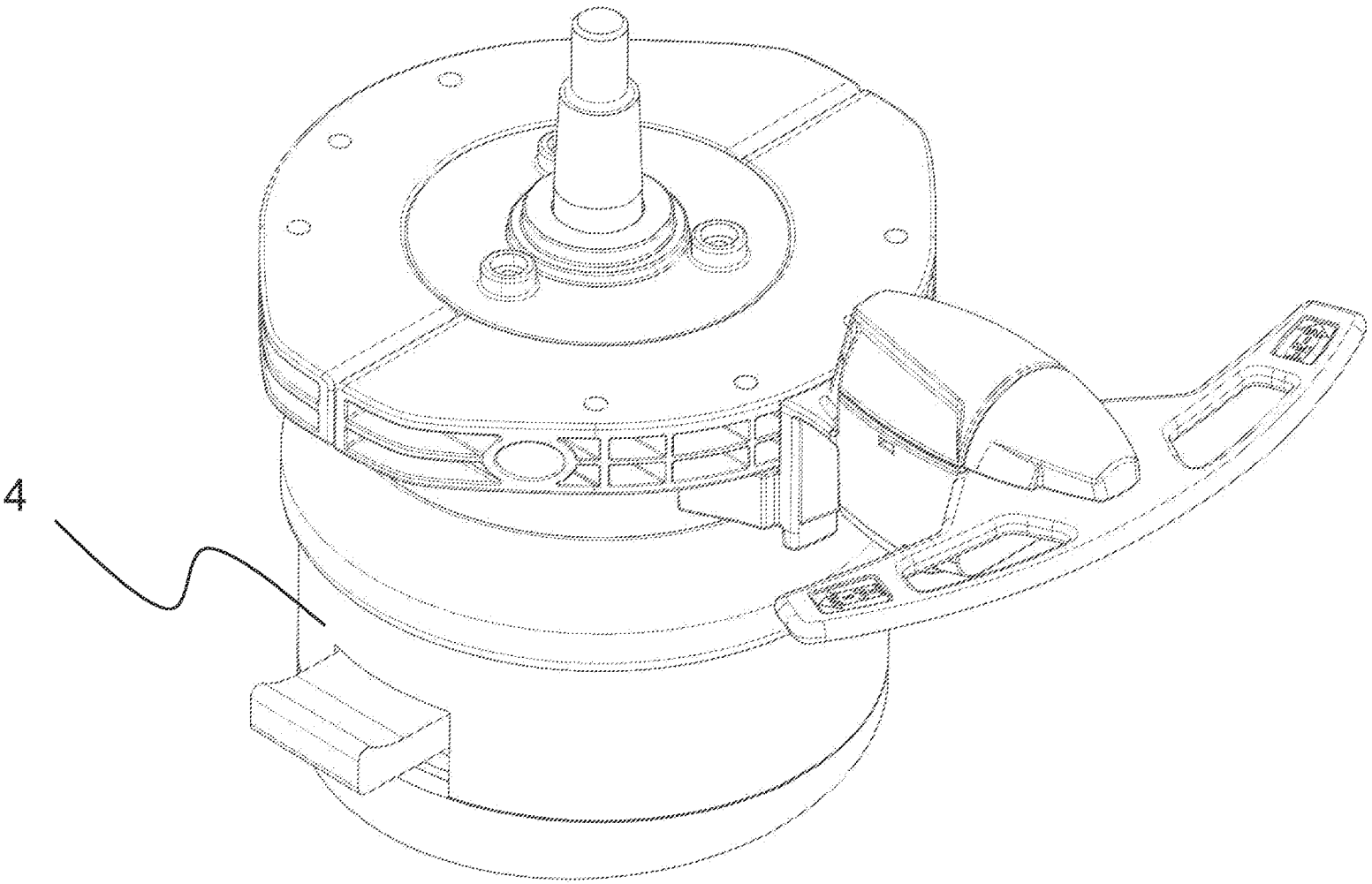
FIG. 6 is the device of the present invention according to a further embodiment.

This allows the arm 1 to be mounted both in the upper position, such as shown in FIG. 1, where the drive unit is a pump, and in the lower position, such as shown in FIG. 6, where the drive unit is a tilt 4.

With a particular reference to FIG. 2, the radially innermost annular edge 52 has at least one housing seat 521 for housing a friction element intended to limit or eliminate the relative displacement between the annular element 5 and the drive unit, particularly the outer casing 3 of the pump.

The intermediate switch or changeover switch or switch device preferably is of the electric or electronic type and can have different arrangements.

A first arrangement provides said device to be composed of a switch of the retail type that is a separate constructional part and it comprises the contacts and the mechanical switching members. In this case the member driving the switch device, namely the lever operates a mechanism actuating the switching member already present within the switch composed of the separate element, while this switch is housed within a seat provided in the case that is in the arm 1.

It is clear that it is possible to provide one or more of such switches that can be driven together or in sequence correspondingly to a predetermined displacement movement or travel of the lever 2.

As an alternative, the lever 2 controls the mechanism that bears one or more mobile contacts that are intended to cooperate with one or more fixed contacts provided in the arm 1 and that are brought in contact with each other or separated from each other depending on the position of the lever 2.

A variant provides for the switch device to comprise itself or to be provided in combination with an electronic control unit for generating control signals, that can be housed also into the arm 1 and that is activated by the movement of the lever 2 or indirectly by the control pulses generated by the switching of the contacts of the intermediate switch or changeover switch or switch device controlled by the lever 2, such that the switch device emits control signals for example corresponding to the movement/position of the lever 2.

When it is a simple switch, namely there are provided two electric contacts that are brought in a mutual contact condition or mutual separation condition, then the movement of the lever 2 causes an electric circuit to pass from the closed condition to the open condition or vice versa thus generating control pulses.

Although the example is described with reference to the electric variant it is clear that the same functionalities are transferable on other types of plants, such as hydraulic or oil-hydraulic ones, etc.

With a particular reference to FIG. 1, the lever 2 is mounted on the arm 1 in a manner rotatable about an axis A parallel to the longitudinal axis of the arm 1, such that a rotation of the lever 2, in a clockwise or counterclockwise direction, causes the switch to be closed.

The axis of the arm 1 in this case is an axis provided in the plane parallel to or containing the axis of rotation of the shaft 10 of the drive unit for the steering actuator, that is the axis of rotation of the wheel (not shown) and which plane is radial with respect to said axis or secant to the casing 3 holding the drive device for the steering actuator.

The shown lever 2 preferably has the shape of a rocker arm, that is the oscillation axis thereof is transversal to its longitudinal extension and it coincides with an intermediate region of said lever with reference to the longitudinal extension thereof.

In such arrangement, the lever 2 identifies three different conditions.

The first one is an intermediate neutral condition that for example can correspond to an open condition of the contacts of a changeover switch that alternatively brings two contacts in contact with each other with a third contact.

In this position, the lever 2 is not rotated and the position is advantageously substantially parallel to a plane having a predetermined inclination with respect to the plane subtended by the steering wheel or the plane perpendicular to the axis of rotation of the shaft 10.

The control device, that is, the intermediate switch or changeover switch or switch device, in its several variant embodiments, for example also in the form of an electronic control unit, does not generate any signal.

Then there is a first oscillation position in one rotational direction with respect to the neutral position of the lever 2 where for example a contact between the third electric contact and one of the remaining two contacts is generated and wherein the lever 2 for example is rotated in the clockwise direction, that is according to the arrow denoted by letter B. In this case the switch device of the control device according to one of its variants and for example according to the variant comprising the electronic unit generates control signals of a first type.

Finally, there is a second position of the lever 2, wherein the lever 2 is rotated in the counterclockwise direction, with respect to the neutral position, that is according to the arrow denoted by C. In this position for example the contact between the third electric contact and the second one of the remaining two contacts is generated and the switch device of the control device according to one of its variants, such as for example according to the variant comprising the electronic unit, generates control signals of a second type. Advantageously it is possible to provide that different rotations of the lever 2 generate different or also possibly equal actuation controls.

With a particular reference to the control of the trim of the motors, for example, it is possible to provide the rotation of the lever 2 along the direction B to lift the motors, while the rotation of the lever 2 along the arrow C to lower the motors.

As can be deduced from the figures, the arm 1 has such a shape to allow the electronic control unit to be housed.

The electronic control unit will have cables connecting to an electronic control system or to the device to be controlled.

Such connection cables can pass in the thickness of the semi-annular elements 54 and 55, for example by forming grooves or slots in the thickness of the radially innermost annular edge 52.

Advantageously, there are provided elastic means holding the lever 2 in position, such to stably keep the lever in a condition corresponding to the neutral position of the lever and to the absence of control signals of the actuators performing the auxiliary functions.

Figure 5:
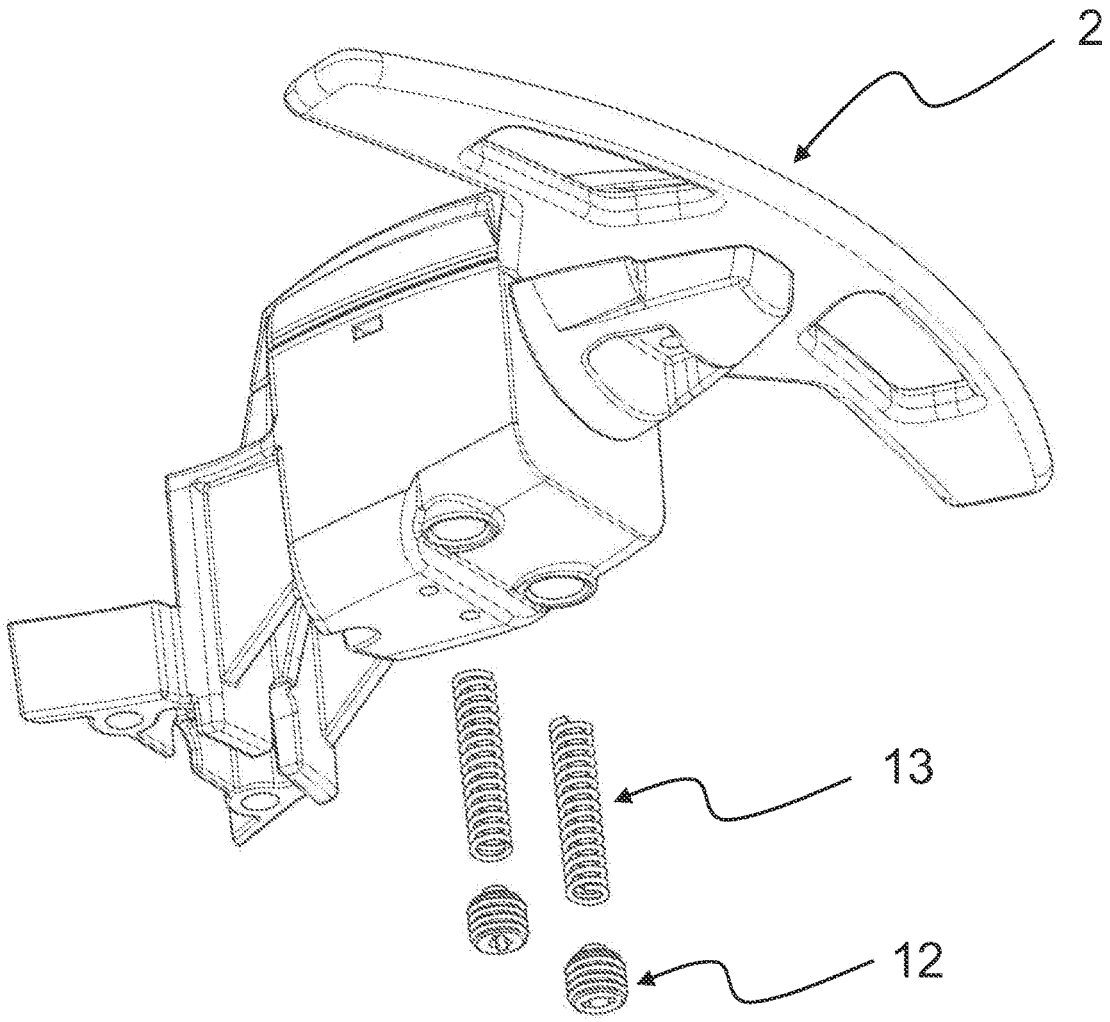
FIG. 5 is a perspective view of a detail belonging to the device of the present invention.

Such elastic means, for example, can be composed of two springs shown in FIG. 5, that hold the lever 2 in the neutral position.

The rotation of the lever 2 in the clockwise or counterclockwise direction causes one or the other spring to be compressed and upon the release of the force action on the lever the compressed spring causes the lever 2 to return back to the neutral position.

According to a further variant embodiment, it is possible to provide means adjusting the elasticity of said position-holding means.

FIG. 5 shows a bottom view of the device of the present invention, wherein such adjusting means are composed of two screws 12, whose rotation allows the hardness of the springs 13 to be adjusted.

The springs can be mounted already slightly compressed and the tightening/untightening of the screws 12 allows the compression of the springs to be increased or decreased while adjusting the resistance of the lever 2 to the rotation.

In this case, for example, the lever 2 controls the oscillation of a shaft that controls a cam intended to activate one or more switches mounted in the arm 1, said cam cooperating with mechanical members actuating said one or more switches. Since the cam has a circumferential track that, depending on the angular position of the shaft and therefore of the lever 2, generates the desired switching conditions correspondingly to the control signals to be generated. Said shaft being provided with two radial tabs diametrically opposite to each other or at non identical angular positions that cooperate with the springs 13, each one being interposed between one tab and the adjustable fixed abutment composed of the screw adjustment 12.

According to the variant shown in the figures, the springs 13 operate by compression, but it is possible to provide such springs to operate by extension, by simply changing the configuration thereof and of the adjusting means.

Figure 7B:
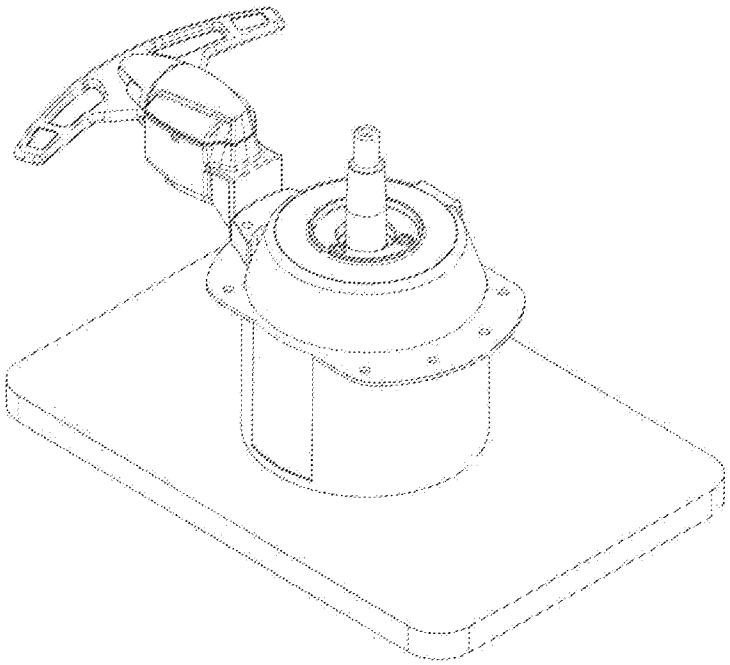
FIGS. 7*a* and 7*b* are the device of the present invention according to a further embodiment.
Figure 7A:
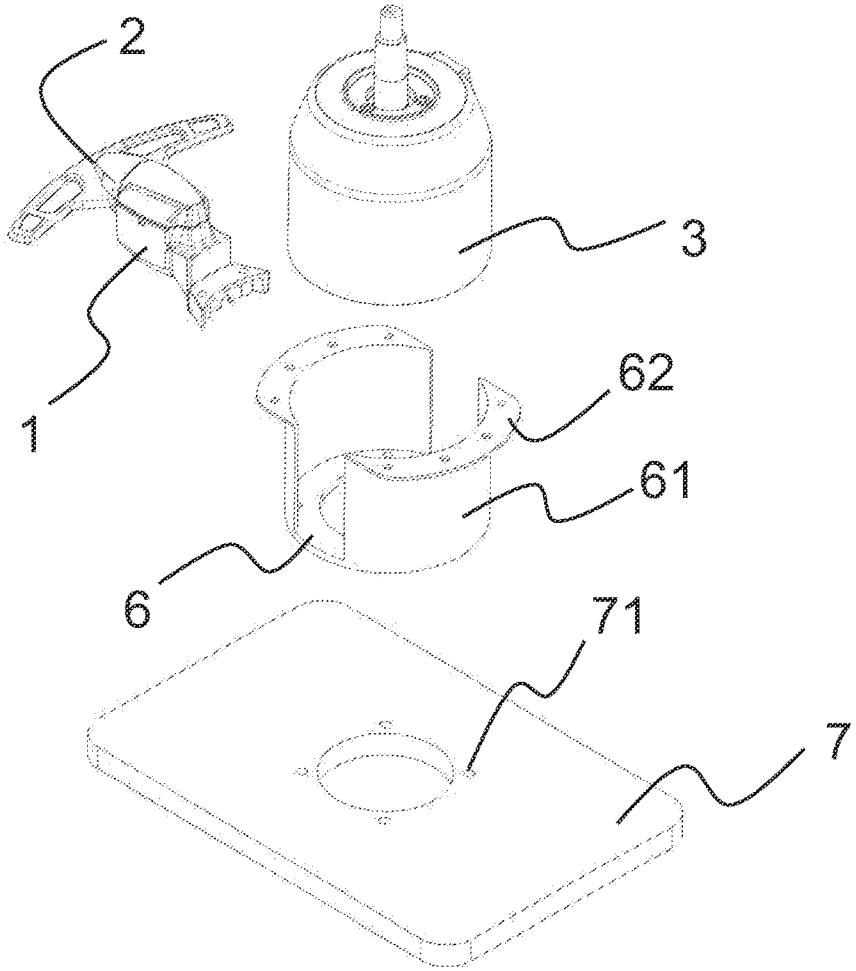

FIGS. 7*a* and 7*b* show a further embodiment of the device of the present invention.

Likewise the previous embodiment, the device is composed of an arm 1 that at one end has an actuation lever 2.

The arm 1 is supported by a support member composed of a support plate 6 having fastening holes for fastening the plate 6 to the boat.

With particular reference to FIG. 7*a*, the support plate 6 can be fastened to the bridge 7 of the boat that has holes 71 at the holes not shown of the support plate 6.

Specifically, the support plate 6 can have different holes such to be adapted to the different bridges 7 present on the market.

Particularly, the support plate 6 is interposed between the drive unit, composed of a pump and the bridge 7.

Finally, the support plate 6 has two uprights 61 that provide at the end opposite to the bridge 7 a fastening terminal 62 that provides holes for fastening the arm 1.

Finally, the arm 1 and the lever 2 can have one or more of the characteristics described above with reference to FIGS. 1 to 6.

In the illustrated embodiment, the plate is made like a cup intended to house therein the casing 3 holding the drive unit for the steering actuator.

In the illustrated example, said unit is of the oil-hydraulic type and the casing 3 houses the pump generally used in such steering systems. This is an example that can be extended with the obvious structural changes and configuration changes to the different steering systems.

Said cup has a flange forming the plate 62 and that can be also a non continuous one. Also in this case, the arm 1 forming the case holding the mechanism driving the switch device in its different possible variants is shown as separated and fastenable to the plate.

As an alternative however it is possible for at least a part of the arm 1 to be made as one piece with the plate 62.

Figure 8A:
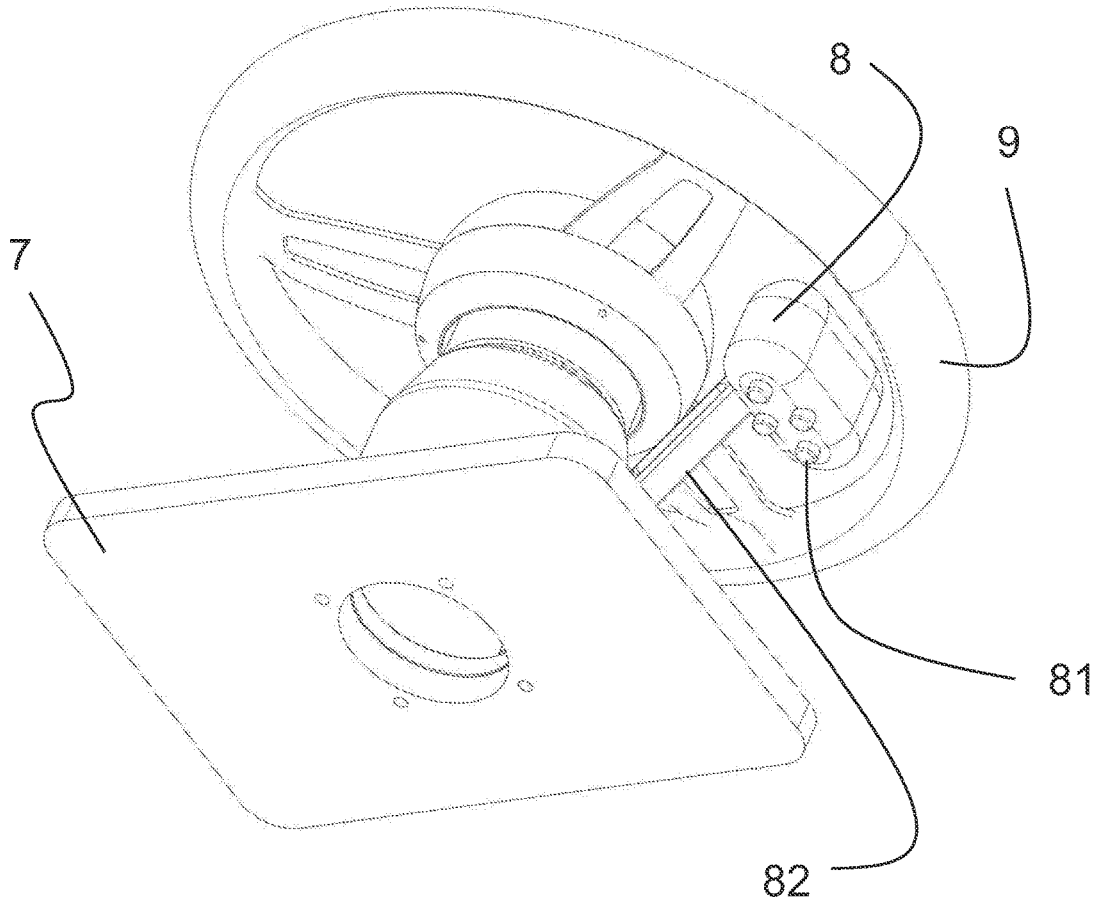
FIGS. 8*a*, 8*b*, and 8*c* are three views of the device of the present invention according to a possible variant embodiment.

FIG. 8*a* shows a bottom view of the device of the present invention according to a possible embodiment.

According to such embodiment, the control device for generating auxiliary controls for a boat, comprises at least one push-button panel element 8 located under the steering control member 9 of the boat.

The push-button panel element 8 provides the push-buttons 81 faced away in a direction opposite to the control member 9 and it is supported by a support arm 82.

The push-buttons 81 can be used for activating any function of the boat, in a manner similar to what disclosed above with reference to the switch device.

Therefore, the push-buttons 81 will be in charge of the generation of electric signals intended to activate functions of the boat such as adjustment of the trim tabs, adjustment of the motor trim, etc.

Figure 9:
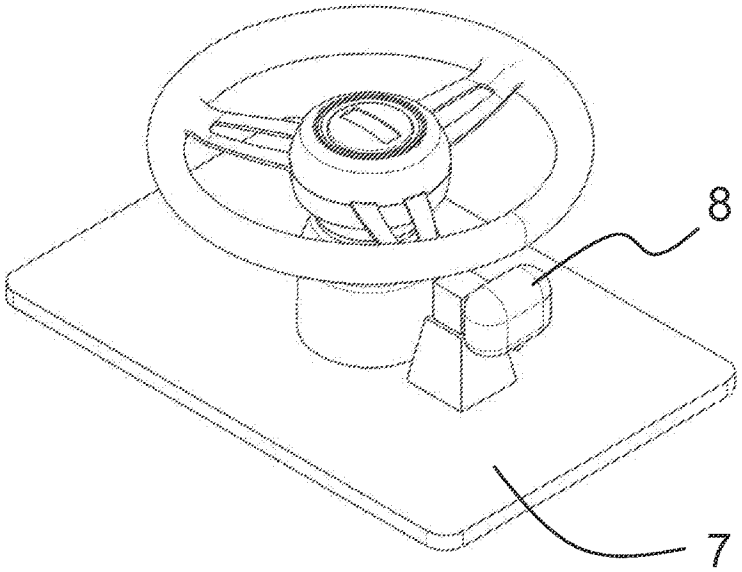
FIG. 9 is a view of the device of the present invention according to one embodiment.
Figure 9:
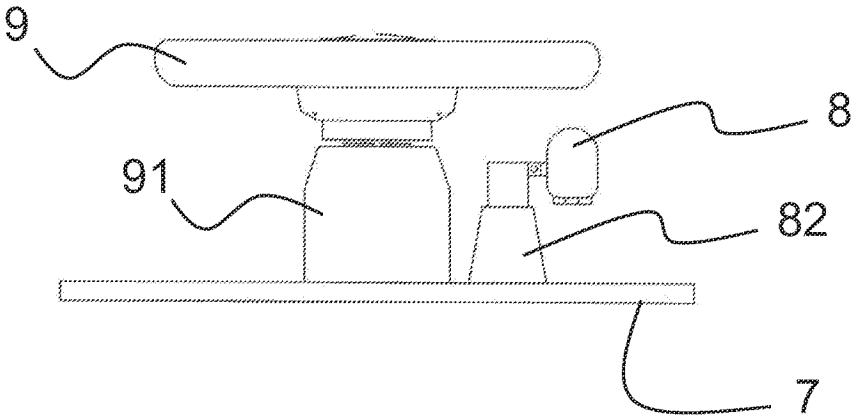

According to a possible embodiment, the control member 9 is connected to a control bridge 7, the support arm 82 being connected by one end thereof to the control bridge 7, such as shown in FIG. 9.

According to one improvement, the support arm 82 can be provided as telescopic, such to height-adjust the push-button panel element 8.

Figure 8B:
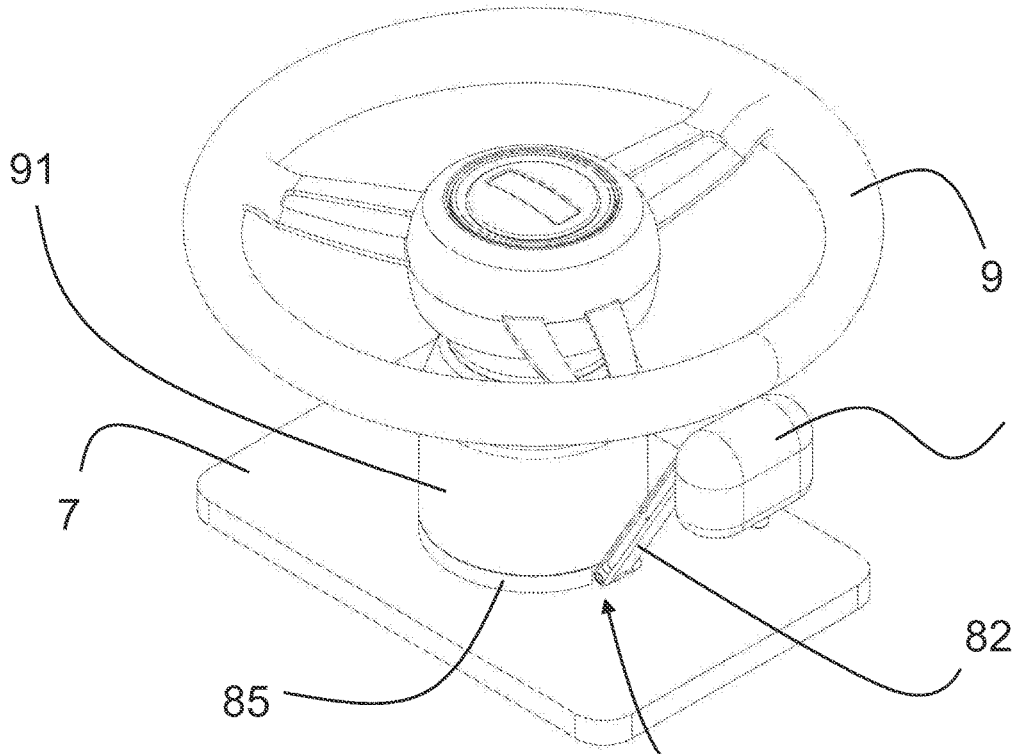
Figure 8C:
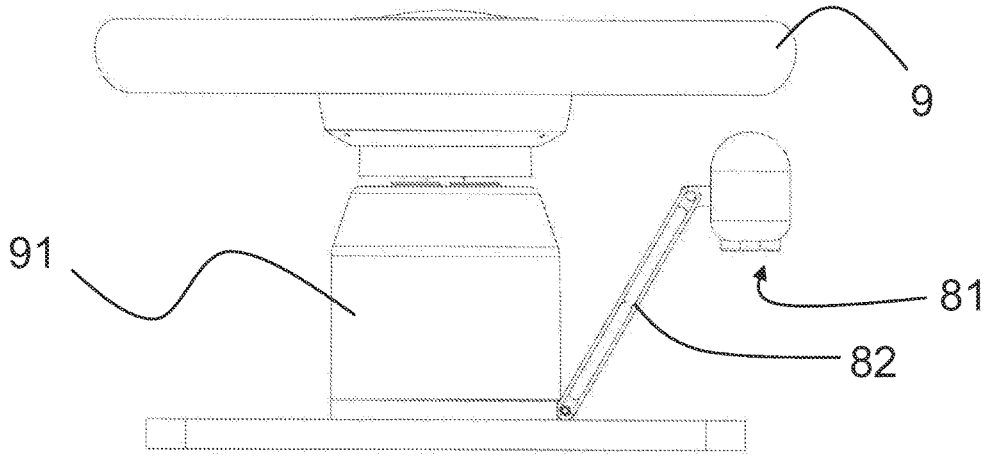

As an alternative and with a particular reference to the FIGS. 8*a* to 8*c*, the control member 9 is connected to a drive unit 91.

The drive unit 91 can be composed of any unit known in the prior art, such as the pump or the trim of the previous figures.

The support arm 82 is connected by one end thereof to the drive unit 91.

With a particular reference to FIGS. 8*a* to 8*c*, the support arm 82 is connected to the drive unit 91 through an annular element 83 that surrounds the outer surface of the drive unit 91.

The annular element 83 can be made according to one or more of the characteristics described above with reference to the annular element 5.

In order to height-adjust the push-button panel element 8, it is possible to provide a connection hinge 84 intended to connect the support arm 82 to the annular element 83.

Figure 10:
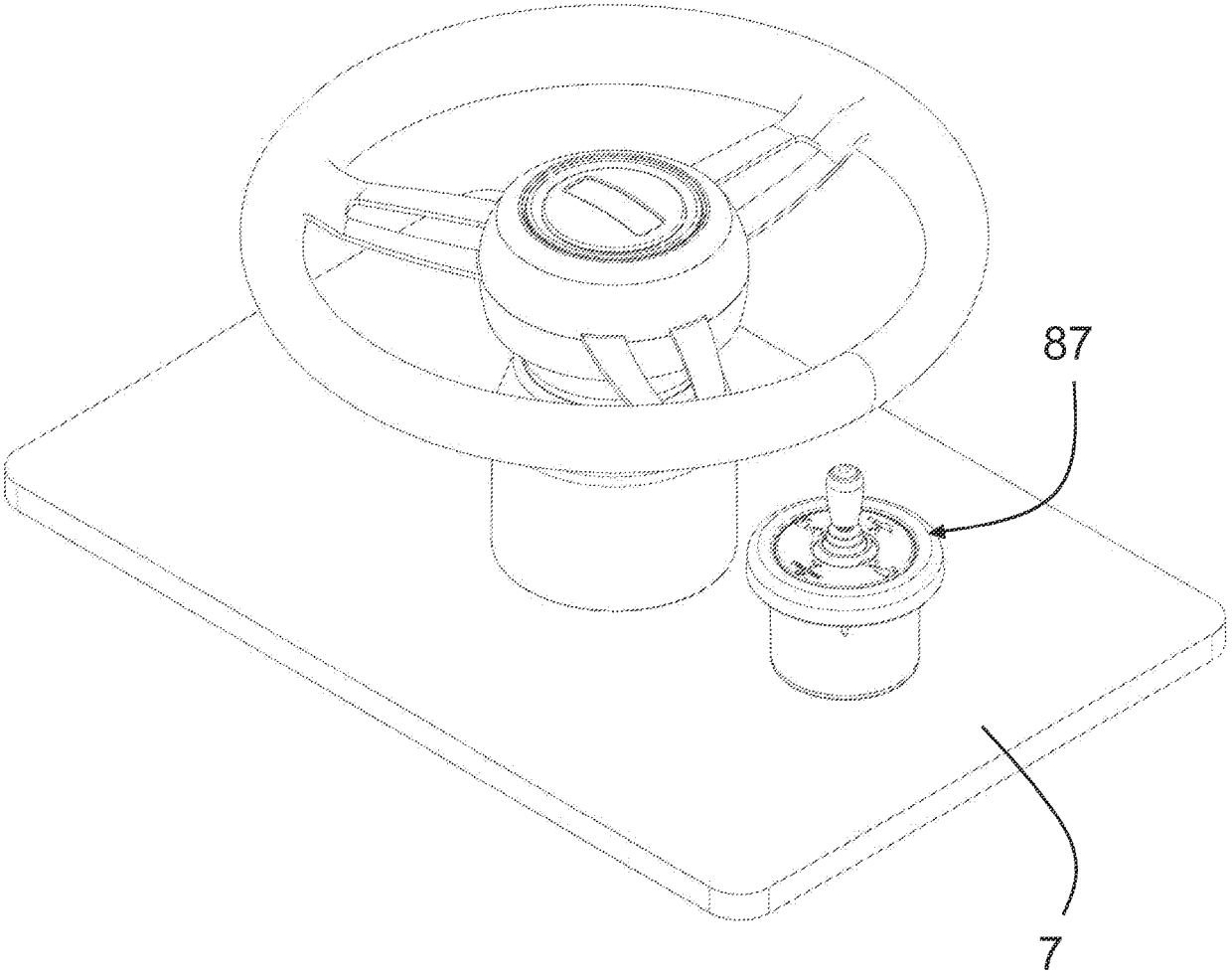
FIG. 10 is a view of the device of the present invention according to a further embodiment.

Finally, according to the variant embodiment shown in the FIG. 10, the control device for generating auxiliary controls for a boat, which boat comprises at least one control member 9 located above a control bridge 7.

The control device is composed of a device of the joystick 87 type connected to the control bridge 7.

The joystick for example can be made according to one or more of the characteristics shown in document US 2012/0079977 to applicant.

Regardless of the arrangement, the movement of the joystick 87, on the basis of the movement direction of the handle, can activate/deactivate different functions, as described before.

According to one embodiment that can be applied to all the described variants, the generation of the controls can be carried out in two different manners:

In one case, the lever 2, the push-button or the joystick are brought in a position generating a control pulse or a pulse train of short duration that are translated into in a variation step for the operating conditions of the controlled function.

In a second case, the action exerted on the control member both a lever 2, a push-button or a joystick is maintained for a predetermined period of time that is read by an electronic control system and that generates a continuous variation according to a predetermined variation control function of the operating conditions of the controlled function.

For example, if the tilt or trim or the number of revolutions of the motor is controlled, by bringing the lever 2 or the push-button or the joystick only for a short time in the increase position the generated pulse is translated into a step of predetermined increase amplitude that can be also proportioned to the short time for driving the lever 2 or the like that is to the pulse duration.

Upon release, the lever 2 or the push-button or the joystick returns to the neutral position and the action stops.

By holding the lever 2, the push button or the joystick in the position generating the pulse for a prolonged time, the control becomes continuous and the generated pulse is continuous over time and it is kept active, by keeping active the actuator of the controlled function till the lever 2, the push-button or the joystick are released and go back in the neutral position. The variation applied on the controlled function is applied in a continuous manner according to a predetermined variation function. Thus for example till the lever 2, push-button or joystick are activated, the tilt angle, the position of the trim tabs or the number of revolutions of the motor are increased or reduced.

To this end the electronic control system that is integrated or associated as the interpreter of the control pulses to the intermediate switch or changeover switch or switch devices can be of the programmable type for changing the response to the duration of the pulses generated by the contacts. The electronic control system can also be provided as a multi-channel for interpreting different types of pulses.

What is claimed is:

1. A control device for generating auxiliary controls for a boat for controlling and regulating at least one boat handling auxiliary functionality, comprising:

at least one intermediate switch, changeover switch, or switch device located below a steering member of said boat, said steering member being connected to a drive unit for one or more steering actuators through a drive shaft (10);

a housing case shaped as an arm (1) that contains the intermediate switch, changeover switch, or switch device and that has at one end a control member (2) for said control device for generating auxiliary controls; and a terminal (5, 61, 62) removably fastening alternatively to a casing (3) holding the drive unit for the steering actuator, or to a part thereof, or to a wall (7) of a bridge or of a dashboard in a region adjacent to a region for mounting said casing (3), wherein said terminal comprises a clamping annular element (5) which comprises a radially innermost annular edge (52) surrounding the casing (3) and which is clamped against a shell surface of said casing (3), by clamping members, said annular element (5) or an appendage (1) associated to said annular element (5) forming a compartment housing the intermediate switch, changeover switch, or switch device and a mechanism driving the intermediate switch, changeover switch, or switch device controlled by the control member (2) of said control device for generating auxiliary controls for the boat.

2. The control device according to claim 1, wherein the control member (2) of the control device for generating auxiliary controls for the boat comprises an oscillating lever (2).

3. The control device according to claim 1, wherein the intermediate switch, changeover switch, or switch device has at least two switching conditions, comprising a first neutral condition where no control pulses for one or more actuators of at least one boat handling auxiliary functionality are generated, or a control signal in a neutral or stationary condition of said auxiliary function and at least one second active switching position where at least one control pulse for said at least one actuator of said at least one boat handling auxiliary functionality is generated for changing, adjusting or modifying a condition of said auxiliary functionality, the at least two switching conditions corresponding to two predetermined positions of the control member (2).

4. The control device according to claim 3, further comprising a third switching condition of the intermediate switch, changeover switch, or switch device that corresponds to at least a third predetermined position of the control member (2), wherein at least one control pulse for said at least one actuator of said at least one boat handling auxiliary functionality is generated for changing, adjusting or modifying the condition of said auxiliary functionality according to a different manner with respect to the manner of the second switching condition, according to a reverse changing, modifying or adjusting function with respect to the function corresponding to the second switching condition.

5. The control device according to claim 1, wherein said control member (2) is movable from a first to at least one second, or from at least a first and alternatively at least a second and third position, which correspond to at least two different or respectively at least three different conditions switching and generating at least two or respectively three different control pulses for actuators of at least one auxiliary functionality, at least one of said two or respectively three positions being a stable position and the at least second or respectively third positions being unstable, further comprising an elastic member holding and recovering said at least first stable position of said control member (2) against whose action said control member is movable by a manual action in the at least said second or respectively said at least third position and against whose elastic force said manual action has to be maintained for holding the control member (2) in said second or respectively third unstable position.

6. A control device for generating auxiliary controls for a boat for controlling and regulating at least one boat handling auxiliary functionality, comprising:

at least one intermediate switch, changeover switch, or switch device located below a steering member of said boat, said steering member being connected to a drive unit for one or more steering actuators through a drive shaft (10);

a housing case shaped as an arm (1) that contains the intermediate switch, changeover switch, or switch device and that has at one end a control member (2) for said control device for generating auxiliary controls; and a terminal (5, 61, 62) removably fastening alternatively to a casing (3) holding the drive unit for the steering actuator, or to a part thereof, or to a wall (7) of a bridge or of a dashboard in a region adjacent to a region for mounting said casing (3), wherein said control member (2) is movable from a first to at least one second, or from at least a first and alternatively at least a second and third position, which correspond to at least two different or respectively at least three different conditions switching and generating at least two or respectively three different control pulses for actuators of at least one auxiliary functionality, at least one of said two or respectively three positions being a stable position and the at least second or respectively third positions being unstable, further comprising an elastic member holding and recovering said at least first stable position of said control member (2) against whose action said control member is movable by a manual action in the at least said second or respectively said at least third position and against whose elastic force said manual action has to be maintained for holding the control member (2) in said second or respectively third unstable position, and wherein said elastic member has an adjustable elastic response.

7. The control device according to claim 3, wherein the intermediate switch, changeover switch, or switch device is electric or electronic and integrates or is associated with an electronic control system interpreting control pulses that generate a signal actuating the steering actuators.

8. The control device according to claim 7, wherein said electronic control system generates different signals driving the actuator or actuators of the auxiliary function or functions, depending on a duration of the switching condition.

9. The control device according to claim 8, wherein the signals deriving from the switching conditions extended over time are transformed into continuous control signals for the actuator or actuators of the auxiliary function or functions that are kept till the control member (2) is held in a corresponding position, while shorter switching conditions are interpreted as controls for the actuator or actuators for changing, modifying or adjusting the auxiliary function according to predetermined steps changing, modifying or adjusting said function.

10. The control device according to claim 1, wherein the annular element comprises an open flexible element whose two ends are fastenable with each other by fastening and adjusting a relative position of the two ends with each other.

11. The control device according to claim 1, wherein the annular element is divided into two semi-annular elements (54, 55), a first semi-annular element (54) and a second semi-annular element (55), by a transverse plane, said semi-annular elements (54, 55) being designed to be coupled/uncoupled by removable fasteners, in a clamping condition and in an open condition respectively of said annular element (5) relative to the casing (3) holding said drive unit, by greater or lower relative mutual approaching of said two semi-annular elements.

12. The control device according to claim 11, wherein, between the radially innermost annular edge (52) of the annular element (5) or of a semi-annular element and a contact surface of the casing (3) holding the drive unit, there is interposed a friction member intended to limit or eliminate relative displacement between said annular element (5) and said casing (3) holding the drive unit.

13. The control device according to claim 1, wherein said arm (1) is supported by a support plate (6) which has fastening holes for fastening said plate (6) to a wall of the bridge (7), of the dashboard of said boat, or to the casing (3) of the drive unit for the steering actuator or actuators.

14. The control device according to claim 1, wherein said control member comprises a lever (2), mounted to said arm (1) so as to rotate about an axis (A) parallel to a longitudinal axis of the arm (1), or to an axis perpendicular to an axis of rotation of the shaft (10) of the drive unit for the steering actuator or actuators and contained in a radial plane or in a plane parallel to said radial plane with respect to said axis of rotation of said shaft (10) of the drive unit for the steering actuator or actuators, such that a rotation of the lever (2) in clockwise or counterclockwise direction (B, C) causes switching conditions of the intermediate switch, changeover switch, or switch device to change.

* * * * *